US005391222A

United States Patent [19]

Nelson et al.

[11] Patent Number: 5,391,222

[45] Date of Patent: Feb. 21, 1995

[54] IN PLACE DISCHARGE ELECTRODE REPLACEMENT ON RIGID FRAME ESP'S

[75] Inventors: Norman D. Nelson, Franklin Township, Summit County; Robert W. Kronenberger, Lake Township, Stark County, both of Ohio

[73] Assignee: The Babcock & Wilcox Company, New Orleans, La.

[21] Appl. No.: 48,021

[22] Filed: Apr. 15, 1993

[51] Int. Cl.[6] ..... B03C 3/86

[52] U.S. Cl. ..... 96/90; 96/92

[58] Field of Search ..... 96/92, 90, 89, 93

[56] References Cited

U.S. PATENT DOCUMENTS

| | | | |
|---|---|---|---|
| 2,867,287 | 1/1959 | Armstrong | 96/90 |
| 4,022,594 | 5/1977 | Baysek | 96/90 |
| 4,349,359 | 9/1982 | Fitch et al. | 96/90 |
| 4,666,474 | 5/1987 | Cook | 96/90 |

FOREIGN PATENT DOCUMENTS

| | | | |
|---|---|---|---|
| 865813 | 6/1941 | France | 96/90 |
| 503495 | 7/1930 | Germany | 96/92 |
| 37-15989 | 10/1962 | Japan | 96/90 |
| 553753 | 6/1943 | United Kingdom | 96/90 |

*Primary Examiner*—Richard L. Chiesa

*Attorney, Agent, or Firm*—Robert J. Edwards; Eric Marich

[57] ABSTRACT

Discharge electrode wires are arranged between parallel discharge tubes by attaching one end of the discharge electrode wire to an end clip within the frame of an electrostatic precipitator having rows of collecting electrode plates. The opposite end of the discharge electrode wire is detachably connected with an in-line spring at one end of the spring. The opposite end of the in-line spring is detachably connected with another end clip. The end clips are detachably engagable with the tubes of the frame and the discharge electrode wire is arranged between parallel tubes by attaching one end clip to one tube and extending the discharge electrode wire through use of the in-line spring in order to attach the second end clip to a parallel frame tube. This arrangement allows for easy access and removal of a damaged discharge electrode wire.

3 Claims, 3 Drawing Sheets

IN PLACE DISCHARGE ELECTRODE REPLACEMENT ON RIGID FRAME ESP'S

FIELD AND BACKGROUND OF THE INVENTION

The present invention relates in general to electrostatic precipitators (ESPt's) and, in particular, to a new and useful discharge electrode arrangement which facilitates field replacement of discharge electrode wires used in electrostatic precipitators.

Since the late 1800's, electrostatic precipitators have been used to remove particulates from smoke and industrial emissions. Electrostatic precipitators are widely used as an important device for combating air pollution. Electrostatic precipitators have proved to be versatile particulate collection devices and are designed for collection of solid particulates, such as fly ash, fluid-bed catalyst fines, or cement kiln dust.

Electrostatic precipitators use a discharge electrode (emitter) which can be comprised of several different constructions. The most commonly used constructions are weighted wire, rigid frame and rigid discharge electrodes. Collecting plates are aligned between the discharge electrodes in rows to form a series of parallel gas flow channels. This invention pertains to the field replacement of broken or damaged wires in a electrostatic precipitator using the rigid frame construction. With the rigid discharge frame, wires are suspended between tubes that make a rectangular frame that hangs between the rows of collecting electrode plates. Voltage is applied to the discharge electrode wires suspended in the gas flow path.

The discharge electrode wires can be configured in various ways within the discharge frame. The high potential on the discharge electrode wires causes a corona discharge, from which electrons migrate out into the gas. These create gas ions, which attach themselves to the particulates in the gas and give the particulates a charge. The collecting electrodes or collector plates are grounded so that high potential difference between them and the discharge electrodes creates a powerful electric field through which the gas must flow. This field exerts a force on the charge particles in the field such that the force moves the particles perpendicular to the gas stream to the collecting electrodes. Typically, the force on a particle 0.5 micrometers in diameter is several thousand times the force of gravity on such a particle.

Because the collector plates are grounded, the particulates lose their charge. The particulates accumulate and can be washed off of the collector plates or dislodged by mechanical agitation of the plates.

Because the spacing is very close within the discharge frames and collector plates, typically varying between 4-½" and 8" center to center, it is very difficult to replace the electrode discharge wires. Normally, the discharge frame arrangement with wires is prefabricated or attached during manufacture. Currently, if any discharge electrode wires become loose or broken, they are typically just removed. If replacement is desired the roof casing of the precipitator must be dismantled in order to gain access to the damaged discharge wires. At present, there is no known discharge frame and discharge electrode wire arrangement that allows for the easy maintenance of damaged discharge electrode wires.

SUMMARY OF THE INVENTION

The present invention comprises an arrangement wherein the discharge frames consisting of pipes or tubes allow the discharge electrode wires to be detachably engaged with the frame. Each discharge electrode wire is connected at each end to an end clip. One end of the discharge electrode wire is directly connected with an end clip while the opposite end of the wire is attached to an in-line spring which is connected between the electrode wire and the other end clip.

One end clip is attached to a tube of the discharge frame and the discharge electrode wire is then stretched by the spring such that the opposite end clip is placed over a parallel tube of the frame thereby extending the discharge electrode wire between parallel tubes.

Because each end clip is detachably engagable with parallel discharge tubes, the discharge electrode wire extended between these tubes by use of the in-line spring is easily replaceable. By disengaging the end clips from the tubes, easier access is provided in the gas lanes of the frame for replacing a damaged wire.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
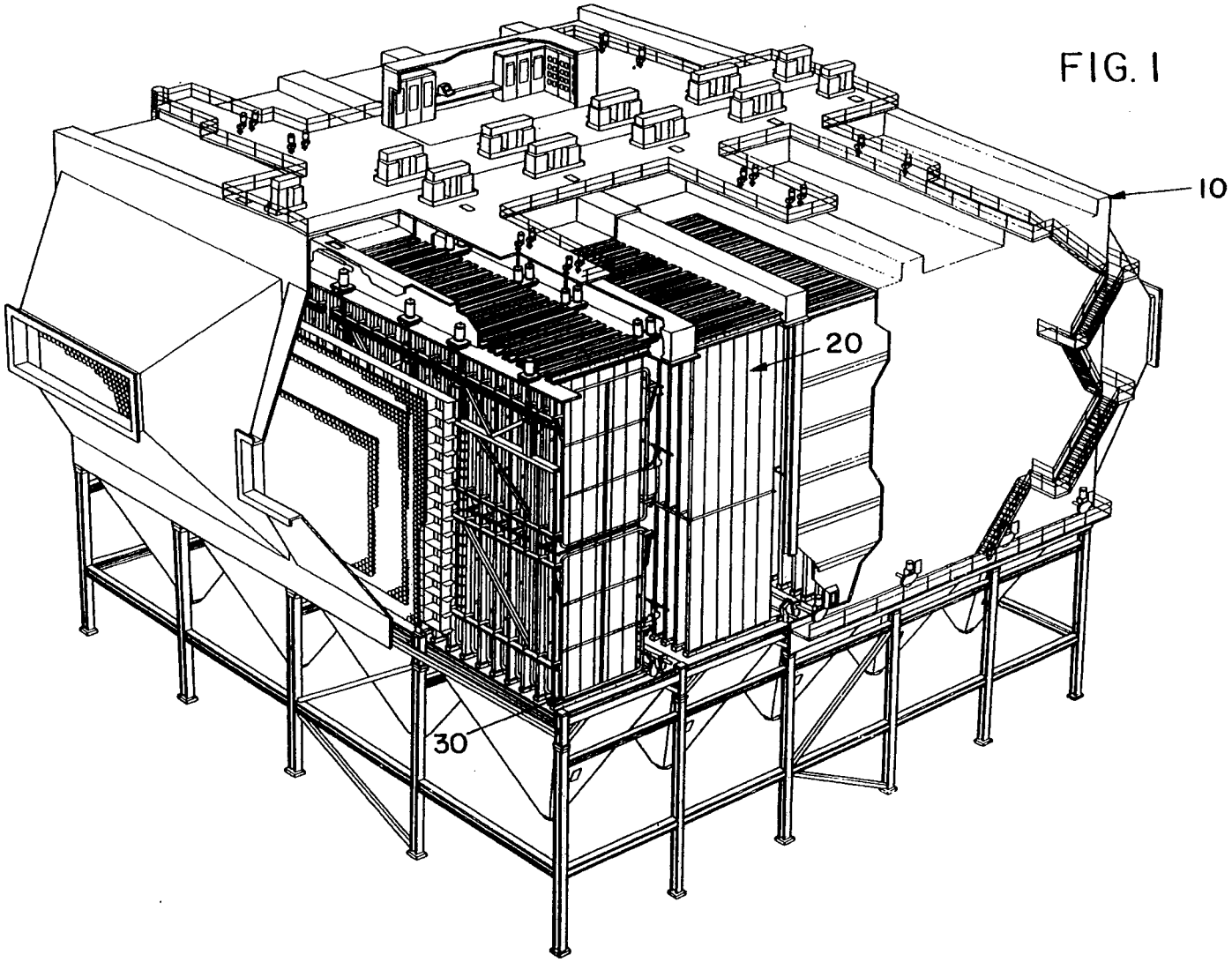
FIG. 1 is a perspective view of an electrostatic precipitator.

FIG. 1 illustrates that the present invention is used within an electrostatic precipitator generally designated 10 having discharge frame tubes or pipes 30 arranged in a discharge frame between collector electrodes or plates 20 for the collection of particulates contained within a gas stream.

Figure 2A:
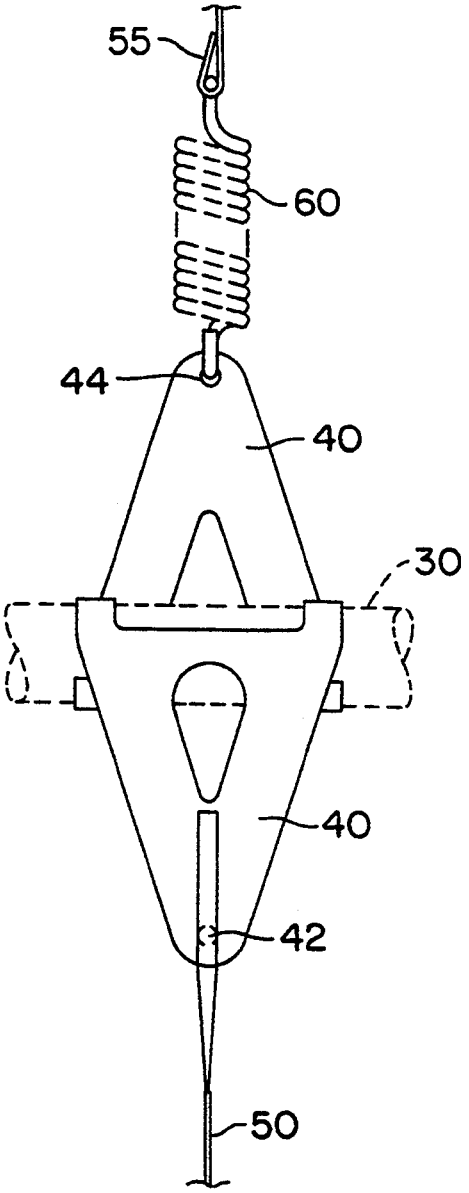
FIG. 2A is an elevational front view of an electrode discharge wire of the precipitator of FIG. 1 according to the present invention.
Figure 2B:
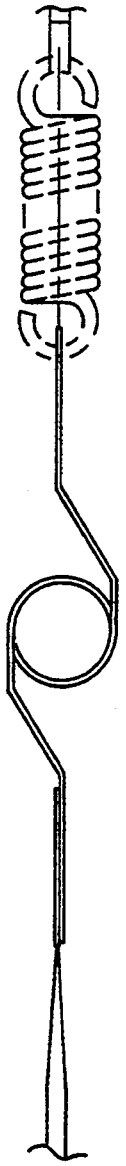
FIG. 2B is an elevational side view of FIG. 2A.
Figure 3:
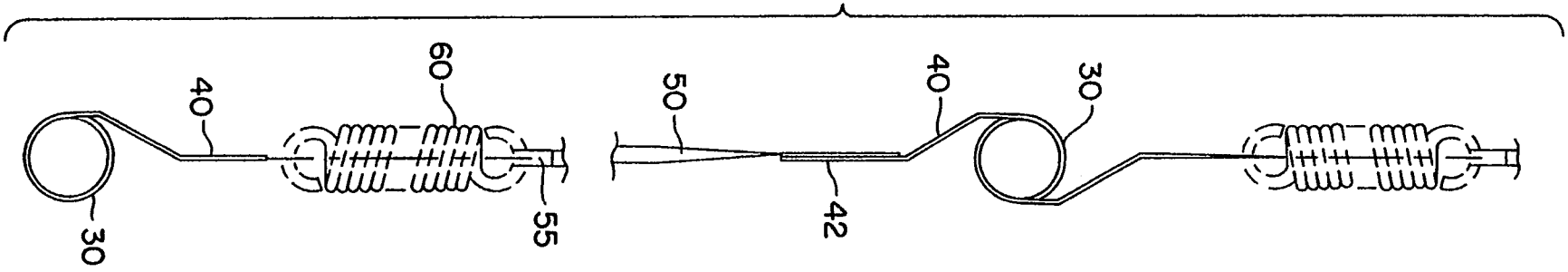
FIG. 3 is an elevational side view of an electrode discharge wire of the precipitator of FIG. 1 according to the present invention.

FIGS. 2A, 2B and 3 show that discharge electrode wires 50 are extended between parallel tubes 30 arranged within the frame of the precipitator 10. One end of discharge electrode wire 50 attached to an end clip 40. A welded connection 42 can be used to attach this end of the electrode wire 50 to the end clip 40. The end clip 40 is detachably engagable with the tubes 30 of the frame of the precipitator 10.

The opposite end of the discharge electrode wire 50 is connected with an in-line spring. The in-line spring 60 is connected with another end clip which is detachably engagable with a parallel tube.

The in-line spring 60 is attached to the end clip 40 through an aperture 44 in the end clip 40. The opposite end of the in-line spring 60 can be attached to the discharge electrode wire 50 by a loop 55 formed on the end of the discharge electrode wire 50 opposite the welded connection 42. The in-line spring 60 is detachably connected with the end clip 40 through the aperture 44 and detachably connected with the discharge electrode wire 50 through the loop 55.

By extending the discharge electrode wire 50 between parallel discharge tubes 30 through use of the in-line spring 60, the replacement of a damaged discharge electrode wire 50 is easily performed. Without disassembling or dismantling the casing of the precipitator 10, a tool can be used to engage a damaged discharge electrode wire 50 between parallel tubes 30 for replacement purposes.

The arrangement of the present invention is detachably engagable with parallel frame tubes 30 for facilitating the easy replacement of a damaged discharge electrode wire 50. The in-line spring 60 detachably connected between the discharge electrode wire 50 and the end clip 40 ensures that the discharge electrode wire 50 is properly extended between parallel tubes 30 for proper charging of the particulates in the gas stream channeled through the electrostatic precipitator 10.

While a specific embodiment of the invention has been shown and described in detail to illustrate the application of the principles of the invention, it will be understood that the invention may be embodied otherwise without departing from such principles.

We claim:

1. A discharge electrode arrangement for an electrostatic precipitator, which facilitates field replacement of discharge electrode wire,the precipitator having a rigid discharge frame with a plurality of tubes, the arrangement comprising:

an end clip detachably engagable with a tube of the discharge frame;

a discharge electrode wire attached to the end clip at one end of the wire by a welded connection to the discharge electrode wire and the end clip;

an in-line spring detachably connected with the other end of the wire at one end of the spring; and a second end clip detachably engagable with a second tube of the discharge frame, the second end clip being detachably connected with the other end of the spring for removably extending the discharge wire between the tubes of the discharge frame.

2. The arrangement according to claim 1, wherein the in-line spring is detachably connected with the discharge electrode wire by detachable engagement of one end of the in-line spring with a loop formed at one end of the discharge electrode wire.

3. The arrangement according to claim 1, wherein the in-line spring is detachably connected with the second end clip by detachably engaging one end of the in-line spring with the second clip through an aperture formed therethrough.

* * * * *